US005582651A

United States Patent [19]

Schnaars

[11] Patent Number: 5,582,651

[45] Date of Patent: Dec. 10, 1996

[54] METHOD FOR CLEANING BULK BAGS

[76] Inventor: Daniel R. Schnaars, 153 S. Long St., Lafayette, La. 70506

[21] Appl. No.: 274,490

[22] Filed: Jul. 13, 1994

[51] Int. Cl.[6] ..... B08B 1/04; B08B 5/04; B08B 9/00; B08B 9/087

[52] U.S. Cl. ..... 134/6; 134/7; 134/8; 134/10; 134/21; 134/22.1; 134/22.18; 134/23; 134/25.1; 134/32; 134/33; 134/37

[58] Field of Search ..... 134/6, 7, 8, 10, 134/22.1, 22.18, 21, 23, 25.1, 32, 33, 37; 15/300.1, 304, 308, 306.1

[56] References Cited

U.S. PATENT DOCUMENTS

| | | | |
|---|---|---|---|
| 1,382,944 | 6/1921 | Wagner | 15/304 |
| 2,156,881 | 5/1939 | Snyder | 15/88.3 |
| 2,333,713 | 11/1943 | Eiben | 15/304 |
| 2,385,511 | 9/1945 | Hays et al. | 15/88.3 |
| 2,394,338 | 2/1946 | Stine | 15/88.3 |
| 2,613,383 | 10/1952 | Rosseau | 15/88.3 |
| 3,545,024 | 12/1970 | Randrup | 15/88.3 |
| 3,678,523 | 7/1972 | Enchelmaier et al. | 15/88.3 |
| 3,862,459 | 1/1975 | Brunette | 15/88.3 |
| 3,998,656 | 12/1976 | Grotto | 15/304 |
| 4,067,749 | 1/1978 | McKinney | 15/304 |

*Primary Examiner*—Zeinab El-Arini
*Attorney, Agent, or Firm*—Pravel, Hewitt, Kimball & Krieger

[57] ABSTRACT

A method for cleaning bulk bags which have been utilized to transport dry bulk, the method including the steps of providing a first bulk bag to be cleaned; mounting the bulk bag on a frame through its inlet and outlet spouts; providing a vertically inclined brush substantially the same length as the mounted bulk bag; introducing air in the mounted bulk bag from the frame to inflate the bulk bag to its filled configuration; rotating the brush against the wall of the bag which in turn causes the bag to rotate on its axis, thus cleaning the exterior wall of the bag, and shaking material off of its interior wall; suctioning off material removed from the brush; collecting the material from the interior of the bag in a collection compartment; and mounting a second bag on the frame while the first bag is being cleaned; following the cleaning of the first bag, rotating the frame to place the second bag in alignment with the brush; inflating the second bag; and rotating the brush against the wall of the second bag to clean the exterior and interior wall of the bag; deflating the first bag and removing it from the frame, and while the second bag is being cleaned, mounting another bag on the frame for cleaning.

13 Claims, 3 Drawing Sheets

METHOD FOR CLEANING BULK BAGS

BACKGROUND OF THE INVENTION

1. Field Of The Invention

The present invention relates to cleaning used bulk material transport bags. More particularly, the present invention relates to a process and apparatus for cleaning a bulk bag which has been emptied of dry bulk material, so that the bag can be reused by a customer.

2. General Background

In the transport of wet and dry materials in bulk is often done through transport of the materials in large bulk bags, which may or may not be lined with polypropylene liners. These bags are capable of transporting a ton of material, and must be purchased by the bulk manufacturers in order to transport the material that needs to be transported. Such bulk bag purchases, for larger manufacturers, have become very expensive, since in most instances the bulk bags are unable to be utilized a second time due to contamination from other products transported. Therefore, there have been attempts made to clean the bulk bags, usually through some sort of wet cleaning process of washing or the like, in order to render the bulk bag reusable. These processes are normally unsuccessful or too time-consuming for the manufacturer.

Therefore, a process and system is needed in the art in order to clean bulk bags which carry dry bulk, which is efficient, fast, and sufficiently thorough so that the bags can be reused for similar dry bulk material, thus eliminating the need to constantly purchase new bulk bags.

SUMMARY OF THE PRESENT INVENTION

The apparatus and method of the present invention solves the shortcomings in the art in a simple and straightforward manner. What is provided is a method for cleaning bulk bags which have been utilized to transport dry bulk, the method including the steps of providing a first bulk bag to be cleaned; mounting the bulk bag on a frame through its inlet and outlet spouts; providing a vertically inclined brush substantially the same length as the mounted bulk bag; introducing air in the mounted bulk bag from the frame to inflate the bulk bag to its filled configuration; rotating the brush against the wall of the bag which in turn causes the bag to rotate on its axis, thus cleaning the exterior wall of the bag, and shaking material off of its interior wall; suctioning off material removed from the brush; collecting the material from the interior of the bag in a collection compartment; and mounting a second bag on the frame while the first bag is being cleaned; following the cleaning of the first bag, rotating the frame to place the second bag in alignment with the brush; inflating the second bag; and rotating the brush against the wall of the second bag to clean the exterior and interior wall of the bag; deflating the first bag and removing it from the frame, and while the second bag is being cleaned, mounting another bag on the frame for cleaning. The apparatus used in the method as described above includes the upright frame, having upper and lower free rotating mounting collars for securing the inlet and down spouts respectively; an air source for introducing air into and inflating the bags; a vertically inclined brush which rotates and cleans the bag as it freely rotates, and a series of collection bins below the frame for collecting the materials swept from the outer wall of the bag, and which fall from the interior of the bag during cleaning.

Therefore, it is a principal object of the present invention to provide a method of cleaning bulk bags through a dry brush, collecting the materials cleaned from the bag, and returning the bag to the customer for reuse after cleaning.

It is a further object of the present invention to provide a dry method of cleaning bulk bags emptied of dry bulk material in such a manner that the bag can be reused for the same type of dry bulk material.

It is a further object of the present invention to provide a system of cleaning dry material bulk bags for reuse in a method which is fast, efficient, and thorough, so that the bag may be returned to the customer for reuse.

It is a further object of the present invention to provide a cleaning system for bulk bags incorporating a tracking system which utilizes a bar code on each bag so that the bag may be identified by customer, type of bulk material, status, date received, date cleaned, date returned, and other tracking facts.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
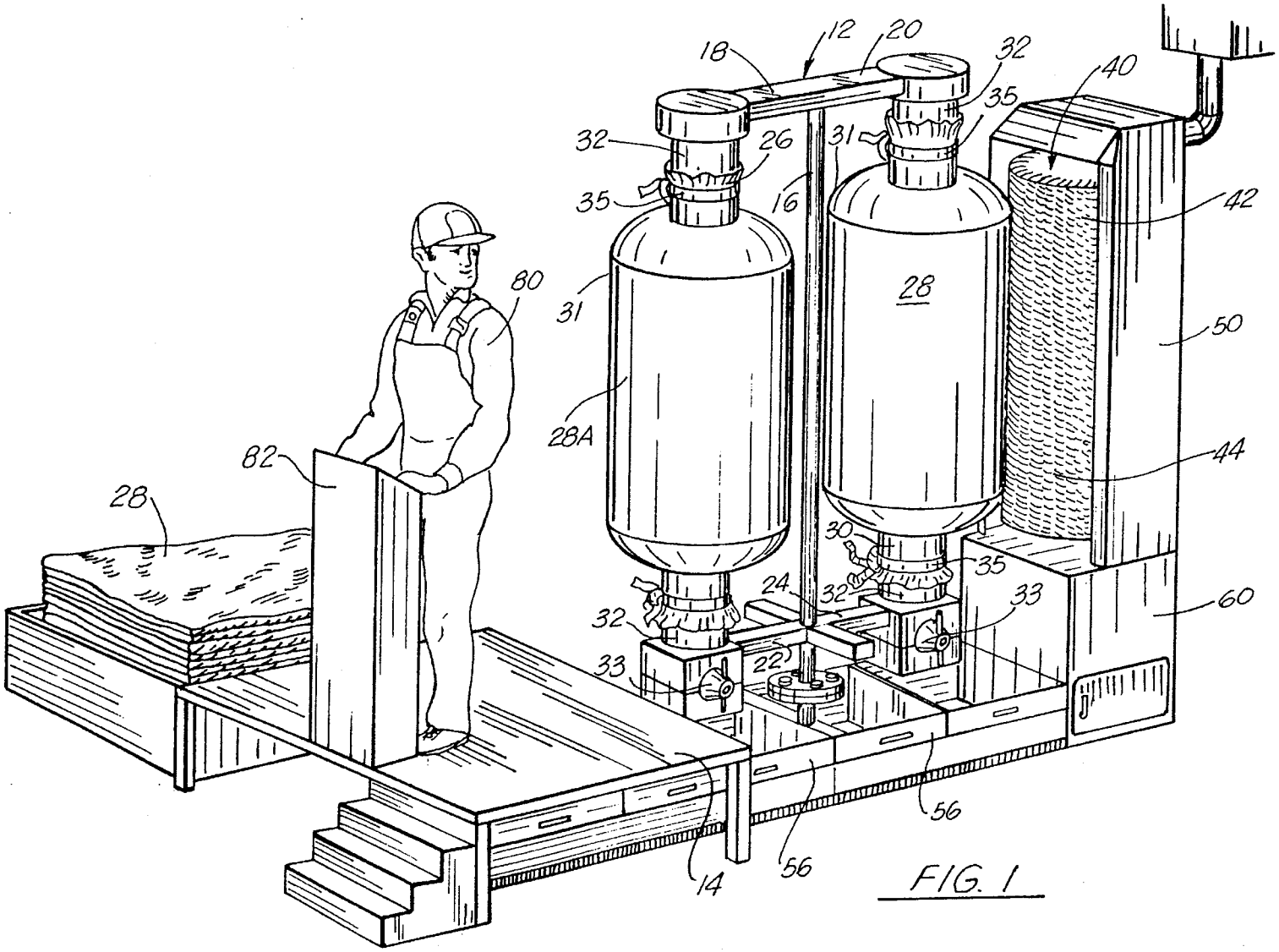
FIG. 1 is an overall perspective view of the preferred embodiment of the system of the present invention.
Figure 2:
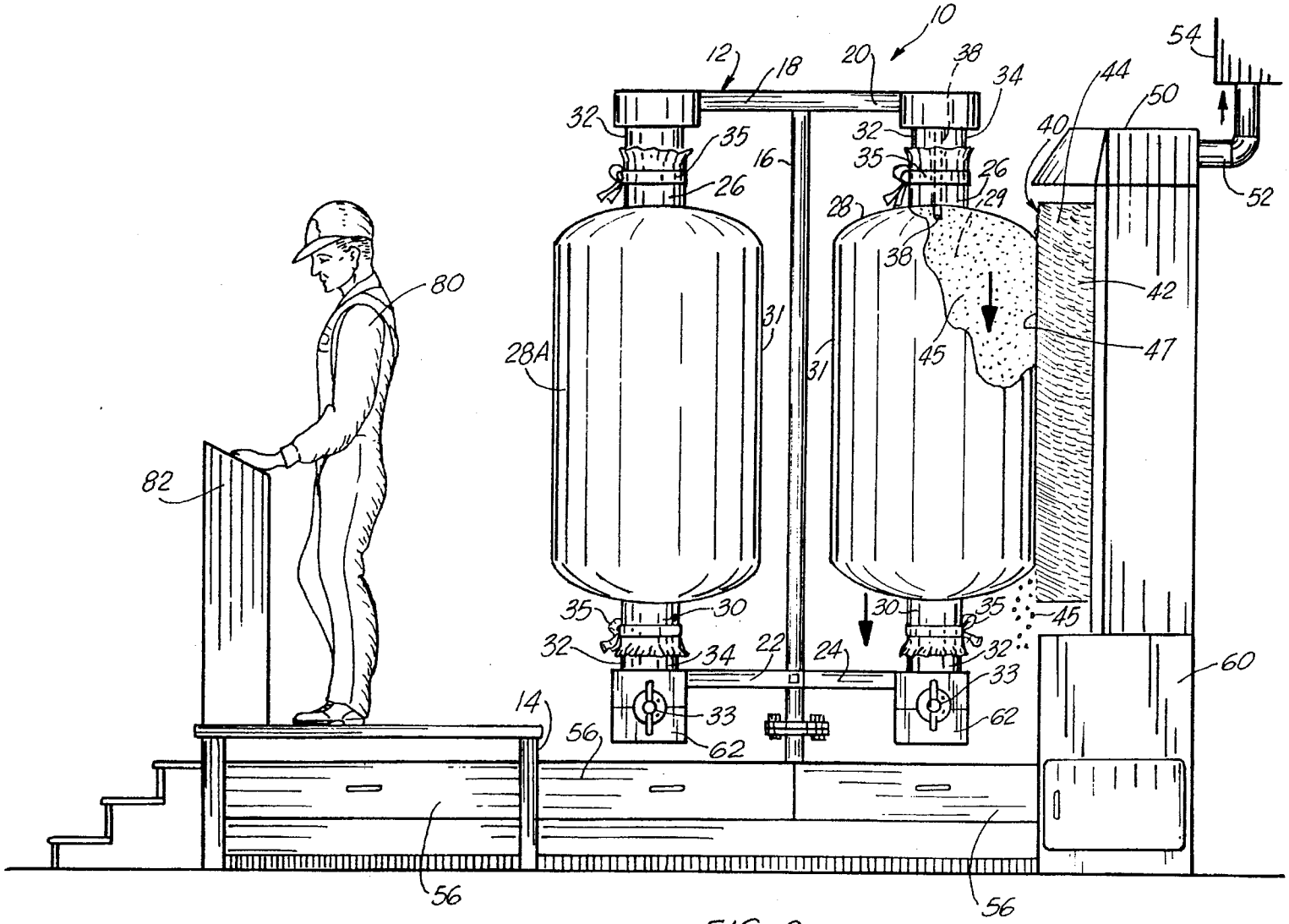
FIG. 2 is an overall side view of the preferred embodiment of the cleaning system of the present invention.
Figure 3:
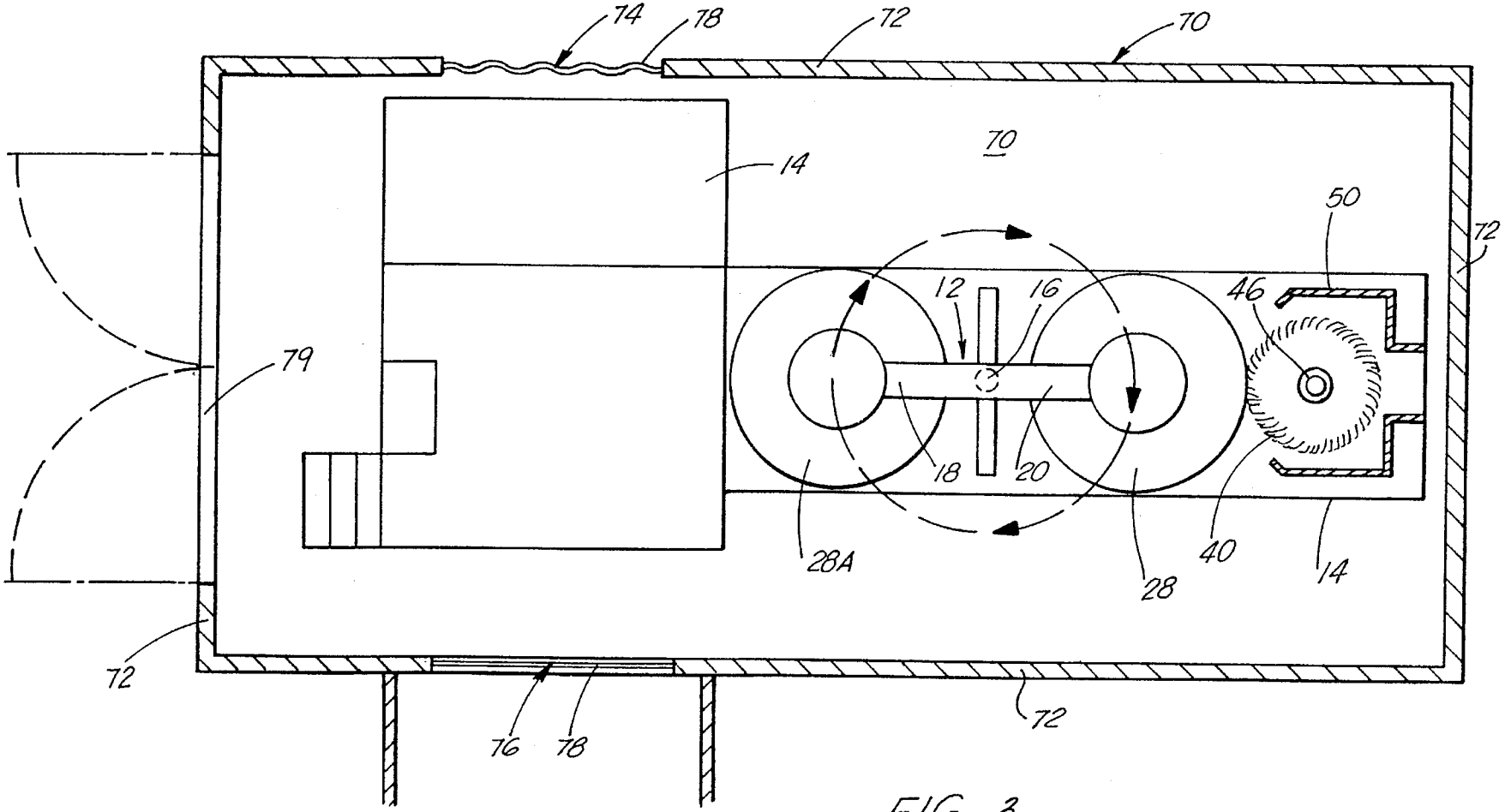
FIG. 3 is a top view of the preferred embodiment of the cleaning system of the present invention.

FIGS. 1 through 3 illustrate the preferred embodiment of the present invention by the numeral 10. As illustrated in the figures, system 10 would comprise an upright frame 12 positioned on a platform 14 or the like for cleaning bulk bag 28, a type of bag having an upper inlet spout 26 for receiving bulk material into the bag and a lower down spout 30 for allowing material to be removed from the bag when the down spout 30 is released. The bulk bag generally being of the type having wall portions, a top portion, a bottom portion, an inlet spout mounted on the top portion and a downspout mounted on the bottom portion and defining an interior space therein, as illustrated in FIG. 1. Frame 12 further includes a central support post 16, and a pair of upper support arms 18, 20 and a corresponding pair of lower support arms 22, 24, as will be described further. Each of the pair of upper arms 18, 20 and lower support arms 22, 24 are spaced sufficiency apart so as to mount the upper inlet spout 26 of a bulk bag 28 to the upper arms 18, 20, and the downspout 30 of bulk bag 28 to lower arms 22, 24, during the method.

The means for mounting the inlet and down spouts to the upper and lower arms, respectively would include a circular collar 32, mounted on each upper support arm 18, 20, and on each lower support arm 22, 24, each collar 32 being freely rotatable in relation to each of the arms, the collar 32 having a wall portion 34, of a circumference slightly smaller than the circumference of the inlet and down spouts of bulk bags. The inlet spout 26 and downspout 30 would be slipped over each collar 32, and would be held in place via an elastic band 35 or the like, so as to seal any passage of material between the wall of the collars and the fabric spouts.

Following the mounting of the spouts as illustrated, following the mounting of a first bag 28 as illustrated, the frame 12 is rotated along its central post 16, so that the first bag 28 is 180 degrees from its original position. Air under pressure is introduced into the bag space 29 of bulk bag 28 from the upper mounting arm 18, via air line 38. The passageway through the downspout 30 is sealed off with a valving member 33, so that the air would inflate the bulk bag to a configuration, where the walls 31 of the bag 28 are expanded outward as illustrated. At that point, first bag 28 is in contact with a brush means 40. This will be described further. Following the rotation of bag 28, a second bulk bag 28A is mounted on arms 18, 20, 22, 24, in the same manner as bag 28 was mounted.

Brush means 40 comprises a vertically positioned brush 42, having a multitude of bristles 44, extending from a central core 46. Brush 42 would be of similar length to the length of the bulk bag wall 31, for the most efficient cleaning. Brush 42 would be motor driven, and would be rotated at a high speed, similar to the type of brush utilized in vehicle wash stations. Upon rotation of brush 42, the bristles 44 make sufficient contact with the wall 31 of bulk bag 28 so as to cause the free-rotating bag to spin, thus causing the material 45 on the outside of the bag 28 to become dislodged by the brush bristles 44. Furthermore, the contact of the bristles 44 against the wall of bag 28, coupled with the spinning of the bag, causes sufficient jarring and shaking of the bag to dislodge dry materials 45 clinging to the inner wall 47 of the inflated bag 28. Therefore, in this process, both the interior wall and the exterior wall of the bag is cleaned of dry materials.

The collection of the dry materials from the bag is accomplished in several ways. The brush 42 is housed within a housing 50, surrounding the brush 42. There is provided an air line 52 leading into the housing, for effecting a suction within the housing 50. Therefore, as any material from the exterior wall 31 of bag 28 is returned into the housing by brush 42, the material is sucked up into airline 52 and deposited in a collection bin 54. Any material knocked from the exterior of the bag which falls from the brush 42, would be collected in a series of collection trays 56 along the floor of the platform 14 which could then be removed and dumped into a collection vessel 60. Meanwhile, the material knocked from within the bag, would fall from the downspout 30 and collect on the surface of the valving member 33, which is in the closed position. When the air flow to the bag 28 is shut off, the valving member 33 is manually opened, and the material 45 is allowed to fall in yet another collection bin 62 for collection. This material, together with the material suctioned from the brush housing 50, and collected in bin 54, is joined in the collection vessel 60 for return to the customer, who may then dispose of the material as it sees fit.

While the first bag 28 is undergoing cleaning, a second bag 28A is mounted to frame 12 in a similar fashion. When the cleaning is complete, the brush 42 is shut down, the frame 12 again is rotated 180 degrees, and the second bag 28A is then inflated, and is then in position for cleaning. While the second bag 28A is being cleaned, the first bag 28 is removed from frame 12, set aside as a clean bag, and another bag to be cleaned is mounted on frame 12 for the cleaning process. In the preferred embodiment, there would be a number of bags which would be cleaned originating from the same customer, with the same dry bulk material, so that when the bags are cleaned, they may be folded, palleted, and returned to the customer, together with the volume of dry material cleaned from the bags and collected in collection vessel 60.

The process which is carried out in the preferred embodiment of the present invention, would preferably take place within a confined area 70, as seen in top view in FIG. 3. The confined area 70 would comprise a plurality of upright walls 72, having an inlet window 74 and an outlet window 76, each of the windows 74, 76 is provided with a flexible fabric or plastic covering 78 so that bags may be pulled through the inlet window for use with the process and cleaned bags may be removed via the outlet window 78. The air pressure within enclosure 70, would be maintained under a negative air pressure, so that material which is cleaned from the bag would not tend to flow into other parts of the operation but would be maintained within the enclosed area 70 during the process. Further, the enclosure 70 would include a double door entry 79 for egress and ingress into the enclose 70. As further illustrated in the FIGURES, the process would be undertaken by an operator 80 who would have both manual and powered operation of the system through operation panel 82 as illustrated.

The process includes a tracking system utilizing a bar code on each bag so that the bag may be identified by customer, type of bulk, status, date received, date cleaned, date returned, and tracking of the bag throughout its life. Those bags which need refurbishing, other than cleaning, may be refurbished, or if too badly damaged, would be destroyed, and its status reported to the customer.

The following table lists the part numbers and part descriptions as used herein and in the drawings attached hereto.

PARTS LIST

| Part Number | Description |
|---|---|
| 10 | system |
| 12 | frame |
| 14 | platform |
| 16 | central support post |
| 18, 20 | upper support arm |
| 22, 24 | lower support arms |
| 26 | inlet spout |
| 28 | bulk bag |
| 28A | second bulk bag |
| 29 | bag space |
| 30 | down spout |
| 31 | walls |
| 32 | circular collar |
| 33 | valving member |
| 34 | wall portion |
| 35 | elastic band |
| 40 | brush means |
| 42 | brush |
| 44 | bristles |
| 45 | material |
| 46 | central core |
| 47 | inner wall |
| 50 | housing |
| 52 | air line |
| 54 | collection bin |
| 56 | collection trays |
| 60 | collection vessel |
| 62 | second collection bin |
| 70 | confined area |
| 72 | upright wall |
| 74, 76 | windows |
| 78 | plastic covering |
| 79 | double door entry |
| 80 | operator |
| 82 | operation panel |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method of cleaning bulk bags, having wall portions, a top portion, a bottom portion, an inlet spout mounted on the top portion and a downspout mounted on the bottom portion, and defining an interior space therein, comprising the following steps:

a) providing a frame;

b) mounting the bulk bag on the frame via the inlet spout downspout in a vertical plane;

c) introducing air under pressure into the bag to inflate the bag;

d) rotating a brush with bristles against the wall portions of the bag, to impart rotation of the bag by the bristles of the brush, and to further dislodge material collected on an inner and outer surface of the wall portions of the bag; and e) collecting the material at the downspout which has been dislodged from the inner and outer surfaces of the wall portions of the bag while the bag is being rotated by contact with the brush bristles.

2. The method in claim 1, further comprising the step of rotating the bag 180 degrees prior to introducing air under pressure into the bag to inflate the bag against the brush bristles.

3. The method in claim 1, wherein the inlet spouts and down spouts are sealing mounted on the frame around freely rotating collar.

4. The method in claim 3, wherein the collar upon which the downspout is mounted is provided with a valve so that the valve is closed off when the bag is inflated to prevent loss of air.

5. The method in claim 1 further comprising the step of providing a collection bin beneath the bag to collect any material removed from the bag during cleaning.

6. The method in claim 1, further comprising the step of providing a housing around the brush to collect material from the brush through a suction line into the housing.

7. The method in claim 1, further providing a collection bin for collecting all material removed from the bags cleaned for returning to the customer.

8. The method in claim 1, further comprising the step of mounting a second bag on the frame while the bag is being cleaned and repeating the process in steps b through e.

9. A method of cleaning bulk bags, having wall portions, a top portion, a bottom portion, an inlet spout mounted on the top portion and a downspout mounted on the bottom portion, and defining an interior space therein, comprising the following steps:

a) providing a vertical frame;

b) mounting a first bulk bag on the frame at the inlet spout and downspout of the bag;

c) introducing air under pressure into a first bag to inflate the bag;

d) providing a vertically inclined brush along substantially a length of the bag wall portion;

e) rotating the frame so that the first bag is positioned against or adjacent the brush;

f) activating the brush so that the brush rotates and makes contact with the wall of the bag, to impart rotation of the bag by the brush bristles;

g) collecting any material dislodged from an inner surface and outer surface of the wall portion of the bag while the bag is being rotated by the brush;

h) mounting a second bag on the frame while the first bag is being cleaned by the brush;

i) following cleaning of the first bag, rotating the frame so that the second bag can be cleaned by the brush; and j) removing the first bag and mounting another bag while the second bag is cleaned.

10. The method in claim 9, wherein the inlet spouts and down spouts are sealing mounted on the frame around freely rotating collar means.

11. The method in claim 10, wherein the collar upon which the downspout is mounted is provided with a valve so that the valve is closed off when the bag is inflated to prevent loss of air.

12. The method in claim 10, further comprising the step of providing collection bins beneath the bag being cleaned to collect any material removed from the bag during cleaning.

13. A method of cleaning bulk bags, having wall portions, a top portion, a bottom portion, an inlet spout mounted on the top portion and a downspout mounted on the bottom portion, and defining an interior space therein, comprising the following steps:

a) providing a frame;

b) mounting the bulk bag on the frame via the inlet spout and downspout in a vertical plane;

c) introducing air under pressure into the bag to inflate the bag;

d) rotating the brush with bristles against the wall portions of the bag, to impart rotation of the brush bristles, and to further dislodge material collected on an inner and outer surface of the wall portions of the bag; and e) collecting the material at the downspout which has been dislodged from the inner and outer surfaces of the wall portions of the bag while the bag is being rotated by contact with the brush bristles;

f) mounting a second bag on the frame and repeating the process in steps b through e.

* * * * *